US007145297B2

(12) United States Patent
Bohlen et al.

(10) Patent No.: US 7,145,297 B2
(45) Date of Patent: Dec. 5, 2006

(54) L-BAND INDUCTIVE OUTPUT TUBE

(75) Inventors: Heinz P. Bohlen, Kehl (DE); Yanxia Li, Pleasanton, CA (US); Paul A. Krzeminski, San Mateo, CA (US); Edmund T. Davies, Orinda, CA (US); Robert N. Tomoe, Sunol, CA (US)

(73) Assignee: Communications & Power Industries, Inc., Palo Alto, CA (US)

( * ) Notice: Subject to any disclaimer, the term of this patent is extended or adjusted under 35 U.S.C. 154(b) by 0 days.

(21) Appl. No.: 10/982,192

(22) Filed: Nov. 4, 2004

(65) Prior Publication Data

US 2006/0091831 A1 May 4, 2006

(51) Int. Cl.
*H05H 13/00* (2006.01)
*H01J 25/08* (2006.01)

(52) U.S. Cl. ..... 315/502; 315/5.32; 315/5.37; 315/5.39; 315/4

(58) Field of Classification Search ..... 315/5.38, 315/4, 5.29, 5, 5.37, 390, 293, 502, 3.5, 5.39, 315/5.32, 5.31
See application file for complete search history.

(56) References Cited

U.S. PATENT DOCUMENTS

| | | | | |
|---|---|---|---|---|
| 2,515,997 | A | 7/1950 | Haeff | 315/5.3 |
| 2,579,820 | A | 12/1951 | Haller et al. | 330/56 |
| 2,634,383 | A | 4/1953 | Gurewitsch | 315/5.3 |
| 2,840,753 | A | 6/1958 | Dailey | 315/5.2 |
| 2,857,480 | A | 10/1958 | Mihran et al. | 330/45 |
| 2,945,158 | A | 7/1960 | Carson | 315/39 |
| 3,289,032 | A | 11/1966 | Rupert et al. | 315/3.6 |
| 3,339,102 | A | 8/1967 | Johnson | 315/3 |
| 4,119,921 | A | 10/1978 | Warringa et al. | 330/49 |
| 4,480,210 | A * | 10/1984 | Preist et al. | 315/4 |
| 4,494,039 | A | 1/1985 | Kim | 315/4 |
| 4,527,091 | A * | 7/1985 | Preist | 315/5 |
| 4,607,242 | A | 8/1986 | Cozzie | 333/209 |

(Continued)

FOREIGN PATENT DOCUMENTS

| | | |
|---|---|---|
| EP | 343 594 | 11/1989 |

(Continued)

OTHER PUBLICATIONS

Bohlen, H.P., "L-Band Inductive Output Tubes" 2003 4th IEEE International Conference on Vacuum Electronics, May 2003.

(Continued)

*Primary Examiner*—Hoang V. Nguyen
*Assistant Examiner*—Chuc Tran
(74) *Attorney, Agent, or Firm*—Thelen Reid & Priest LLP; David B. Ritchie

(57) ABSTRACT

An inductive output tube (IOT) operates in a frequency range above 1000 MHz. An output window may be provided to separate a vacuum portion of the IOT from an atmospheric pressure portion of the IOT, the output window being surrounded by a cooling air manifold, the manifold including an air input port and a plurality of apertures permitting cooling air to move from the port, through the manifold and into the atmospheric pressure portion of the IOT. The output cavity may include a liquid coolant input port; a lower circular coolant channel coupled to receive liquid coolant from the liquid coolant input port; a vertical coolant channel coupled to receive liquid coolant from the lower circular coolant channel; an upper circular coolant channel coupled to receive liquid coolant from the vertical coolant channel; and a liquid coolant exhaust port coupled to receive liquid coolant from the upper circular coolant channel.

50 Claims, 11 Drawing Sheets

U.S. PATENT DOCUMENTS

| | | | | |
|---|---|---|---|---|
| 4,611,149 | A | 9/1986 | Nelson | 315/5.3 |
| 4,705,988 | A | 11/1987 | Tran et al. | 315/4 |
| 4,905,086 | A | 2/1990 | Tahara | 348/7.23 |
| 5,187,408 | A | 2/1993 | Jodicke et al. | 315/5 |
| 5,233,269 | A | 8/1993 | Lien | 315/5.3 |
| 5,281,923 | A | 1/1994 | Heppinstall | 330/45 |
| 5,317,233 | A | 5/1994 | Lien et al. | 315/5.3 |
| 5,572,092 | A * | 11/1996 | Shrader | 315/5.37 |
| 5,767,625 | A * | 6/1998 | Shrader et al. | 315/5.37 |
| 6,084,353 | A * | 7/2000 | Bohlen | 315/5.32 |
| 6,191,651 | B1 * | 2/2001 | Shrader | 330/44 |

FOREIGN PATENT DOCUMENTS

| | | |
|---|---|---|
| GB | 2 243 943 | 11/1991 |
| GB | 2 259 708 | 3/1993 |
| WO | WO 2004/049378 | 6/2004 |

OTHER PUBLICATIONS

Bohlen, Heinz, "Inductive Output Tubes-Status and Future Direction", RF Conference 2001.

CHK2800W $(K2)^2$ Klystrode® IOT Amplifier, CPI Eimac, www.eimac.com, Jun. 17, 2003.

"K2 Digital Klystrode® IOT Family" Eimac Klystrode® IOT—Quick Reference Data, Eimac Web Pages © copyright 1996 CPI, Eimac Division, Last page updated Sep. 19, 2002.

Preist, Donald H. et al., "The Klystrode-An Unusual Transmitting Tube with Potential for UHF-TV", Proceedings of the IEEE, vol. 70, No. 11, pp. 1318-1325, Nov. 1982.

Woolridge, E. et al., "Combining Cavity for RF Power Sources: Computer Simulation and Low Power Model" Proceedings of EPAC, Jul. 5-9, 2004.

Bohlen, Heinz et al., "Development of a 1.3 GHz Inductive Output Tube for Particle Accelerators," CPI Comm. & Power Industries, EIMAC Division, San Carlos, CA, pp. 225-IEE, 2004.

* cited by examiner

L-BAND INDUCTIVE OUTPUT TUBE

FIELD OF THE INVENTION

The present invention relates generally to inductive output tubes. More particularly, the present invention relates to an inductive output tube adapted to operate in the L-band frequency range.

BACKGROUND OF THE INVENTION

Since the late 1980s the Inductive Output Tube (also known as an "IOT" and a brand of which is marketed by Eimac under the trademark "Klystrode®") has established itself as a useful device for broadcast, applied science and industrial applications in the UHF frequency range, typically operating in the 100 MHz–900 MHz range. Compared to a klystron, the IOT compensates for its lower gain with both superior efficiency and linearity, and it outperforms the tetrode, its next of kin in the electron device family, with regard to power capability and gain. However, it has long been thought that transit time effects limit the useful frequency range of IOTs to frequencies below 1000 MHz. It has been a commonly held belief in the industry that 1000 MHz is a hard threshold beyond which the performance of IOTs as fundamental frequency amplifiers would fall off rapidly.

FIG. 1 is a simplified electronic schematic diagram of a typical IOT 10 in accordance with the prior art. A cathode 12 held at a high negative potential compared to ground (typically a dispenser-type barium cathode) emits a beam of electrons 14. A control grid 16 fed by a radio frequency (RF) input source 32 density modulates the flow of the beam of electrons 14. An anode 18 held at ground potential accelerates the modulated electron beam 14. The modulated electron beam 14 passes through an output gap 20 where output power is extracted from the electron beam to an output resonator 19 by way of an induced electromagnetic field and directed to an output coupling 21 which is typically a coaxial feedline. A collector 22 receives the spent electrons. A grid bias supply 30 provides bias voltage to the grid, a beam power supply disposed between line 34 and line 38 provides the power to accelerate the electrons from the cathode to the anode, and a heater voltage supply 36 provides power to the heater of the cathode in a conventional manner. A solenoid magnet (not shown) typically surrounds the electron beam to focus it and reduce beam divergence. Input circuit 40 is shown schematically and acts to match the impedance of the input signal to the IOT 10.

The idea of employing higher-harmonic versions of IOTs at higher frequency bands was born early on. In a second-harmonic IOT, for example, the frequency-sensitive grid-cathode circuit (see, e.g., U.S. Pat. No. 5,767,625 entitled *High Frequency Vacuum Tube with Closely Spaced Cathode and Non-Emissive Grid* to Shrader et al.) could still be operated reliably in the well-experienced UHF regime, while the re-entrant output cavity could be tuned to a higher harmonic in an L-Band frequency. The main drawback to this approach is the relative length of the electron bunch that the low drive frequency forms. During its passage through the output gap the RF voltage in the output cavity changes its polarity twice: from the acceleration into the deceleration phase and back. Although the maximum of the current passes within the deceleration phase and thus ensures power conversion into the desired frequency, a considerable amount of electrons become accelerated, marginalizing efficiency and gain and causing problems with collector dissipation and X-ray radiation.

An investigation was conducted to see how far up in frequency the fundamental-frequency IOT could be tuned in computer simulation without jeopardizing its performance characteristics, particularly the operation of its critical grid-cathode configuration. An existing one-dimensional IOT computer code of proven reliability was modified to include the effects of grid-cathode transit time into the simulation.

As a first step an IOT electron gun with an established track record in UHF broadcast and science applications was analyzed to determine the change of electron bunch waveform and fundamental RF current versus frequency. The results of the simulation are shown in FIG. 3 which is a graph of simulated fundamental frequency current of an existing IOT gun versus frequency at 22 kV beam voltage and 47.4 V peak RF grid voltage operating in class B. Also interestingly, the useful fundamental RF current carried by the bunches in the simulation does not drop significantly until about 2 GHz (FIG. 3).

Accordingly, it would be highly desirable to develop a fundamental mode L-band IOT with reasonable performance characteristics.

SUMMARY OF THE INVENTION

An inductive output tube (IOT) adapted to operate at frequencies above 1000 MHz includes a cathode for emitting a linear electron beam; a grid comprised of non-electron emissive material for density modulating the beam, wherein an input RF signal is applied between the cathode and the grid; an anode for forming an electric field in combination with the cathode for accelerating the beam; a collector for collecting the spent beam (which may be of the single-stage or multi-stage depressed collector (MSDC) type); and an output cavity resonant to a frequency of the input RF signal, which is positioned between the anode and the collector. Electrons passing through the interaction gap within the cavity induce an RF field in the cavity. A coupler responsive to the RF signal couples the RF power from the cavity to the load.

In an aspect of the invention an output window is provided to separate a vacuum portion of the IOT from an atmospheric pressure portion of the IOT, the output window being surrounded by a cooling air manifold, the manifold including an air input port and a plurality of apertures permitting cooling air to move from the port, through the manifold and across the window into the atmospheric pressure portion of the IOT.

In another aspect of the invention the output cavity includes a liquid coolant input port; a lower coolant channel coupled to receive liquid coolant from the liquid coolant input port; a vertical coolant channel coupled to receive liquid coolant from the lower coolant channel; an upper coolant channel coupled to receive liquid coolant from the vertical coolant channel; and a liquid coolant exhaust port coupled to receive liquid coolant from the upper coolant channel.

In yet another aspect of the invention the output cavity includes a vacuum tight diaphragm which can be moved into and out of the output cavity by manipulating a tuning control accessible on the exterior of the IOT. The tuning control may be bolt moving in threads or another mechanical component adapted to move the diaphragm in and out of the output cavity. Movement of the diaphragm causes a corresponding change in the resonant frequency of the output cavity.

Other aspects of the inventions are described and claimed below, and a further understanding of the nature and advantages of the inventions may be realized by reference to the remaining portions of the specification and the attached drawings.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

In the drawings.

DETAILED DESCRIPTION

Embodiments of the present invention described in the following detailed description are directed at L-band IOTs. Those of ordinary skill in the art will realize that the detailed description is illustrative only and is not intended to restrict the scope of the claimed inventions in any way. Other embodiments of the present invention, beyond those embodiments described in the detailed description, will readily suggest themselves to those of ordinary skill in the art having the benefit of this disclosure. Reference will now be made in detail to implementations of the present invention as illustrated in the accompanying drawings. Where appropriate, the same reference indicators will be used throughout the drawings and the following detailed description to refer to the same or similar parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Based on the findings discussed above, a complete 1300 MHz/15 kW continuous wave IOT was simulated, maintaining the above-described gun configuration. The simulated fundamental mode IOT in accordance with an embodiment of the present invention operating at 1300 MHz at a power output level of 16.4 kW results are in Table 1. Operational data for the simulated IOT is set forth in Table 1 set forth below.

TABLE 1

| Simulated Data for 15 kW CW L-Band IOT | |
|---|---|
| Operational frequency | 1300 MHz |
| Beam voltage | 24 kV |
| Grid bias voltage | −50 V |
| Output power | 16.4 kW |
| Collector dissipation | 5.1 kW |
| Efficiency | 68.3% |
| Drive Power | 63 W |
| Gain | 24 dB |
| Bandwidth (double tuned, −1 dB) | 5 MHz |

Accordingly, a prototype unit was built in accordance with these principles by modifying an existing EIMAC K2 Series UHF IOT to operate at 1300 MHz. The external UHF output section was replaced with an internal 1300 MHz resonator. A 1⅝-inch diameter coaxial output feeder was used which contains an alumina window of the same type commonly used with L-Band klystron devices. The cavity is water-cooled as described in detail below in order to remove waste heat from the cavity as well as to provide stability against de-tuning which above 1000 MHz becomes much more critical than at lower frequencies.

Figure 8:
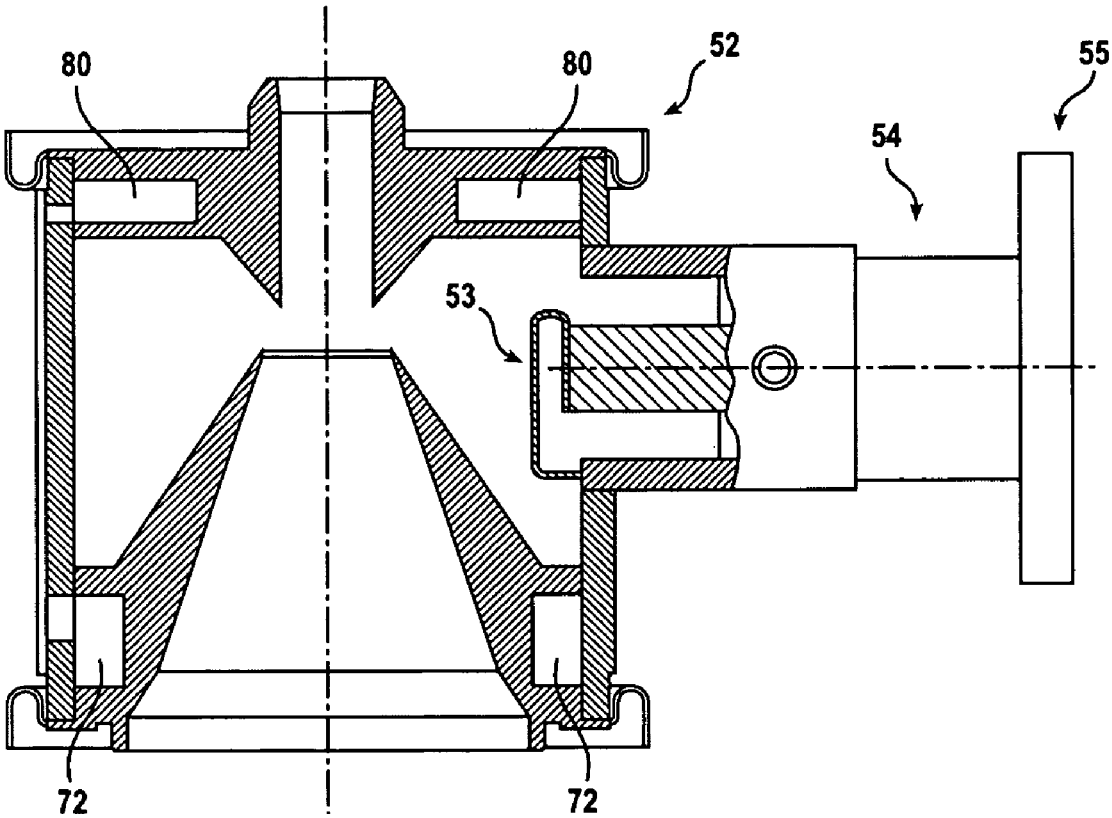
FIG. 8 is a cross-sectional view of the output cavity of the IOT illustrated in FIG. 7.

The input circuit is more complex. The input impedance of an IOT is of the order of 10 ohms, thus the input circuit has to transform the impedance downward from that of the input feeder (typically 50 ohms), instead of upward as in the case of a klystron. The input signal has to be transferred safely and reliably from the ground level to the high-voltage DC potential of the electron gun assembly. High-voltage-safe dimensions and low impedance are not easily married. The input circuit utilized on the 1300 MHz IOT is a modified version of a conventional UHF IOT input circuit. The tuning paddle has been removed and a stub tuner has been added for the purpose of matching the drive signal to the tube. This is shown in FIG. 8 at reference no. 42.

Figure 1:
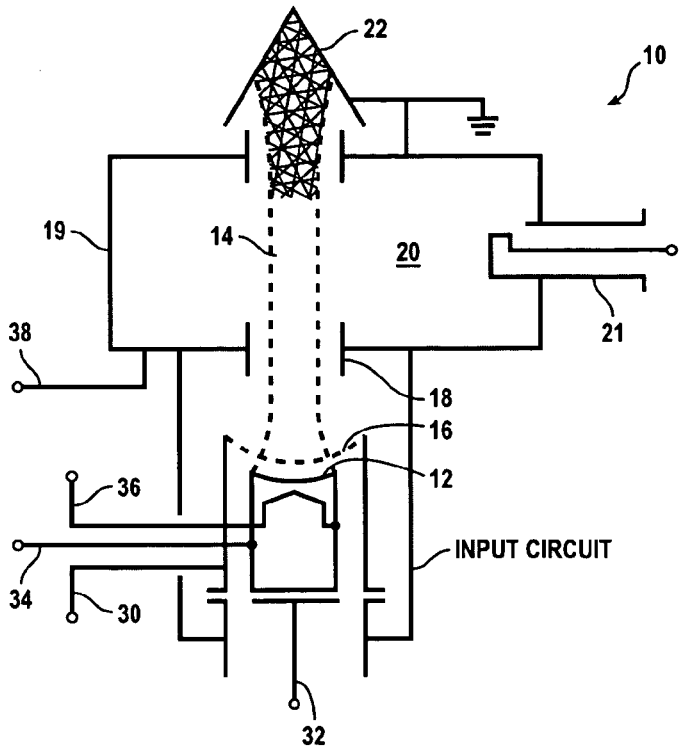
FIG. 1 is a simplified electrical schematic diagram of a typical IOT in accordance with the prior art.
Figure 2:
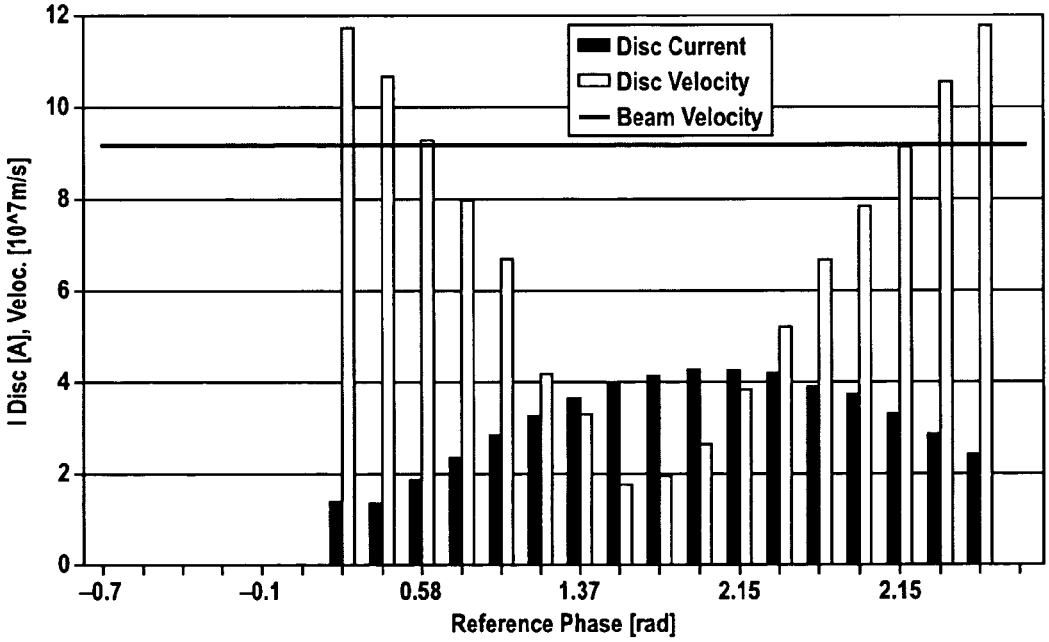
FIG. 2 is a histogram plot of disc velocity and disc current versus reference phase for a simulated second-harmonic IOT operating at L-band frequencies.
Figure 3:
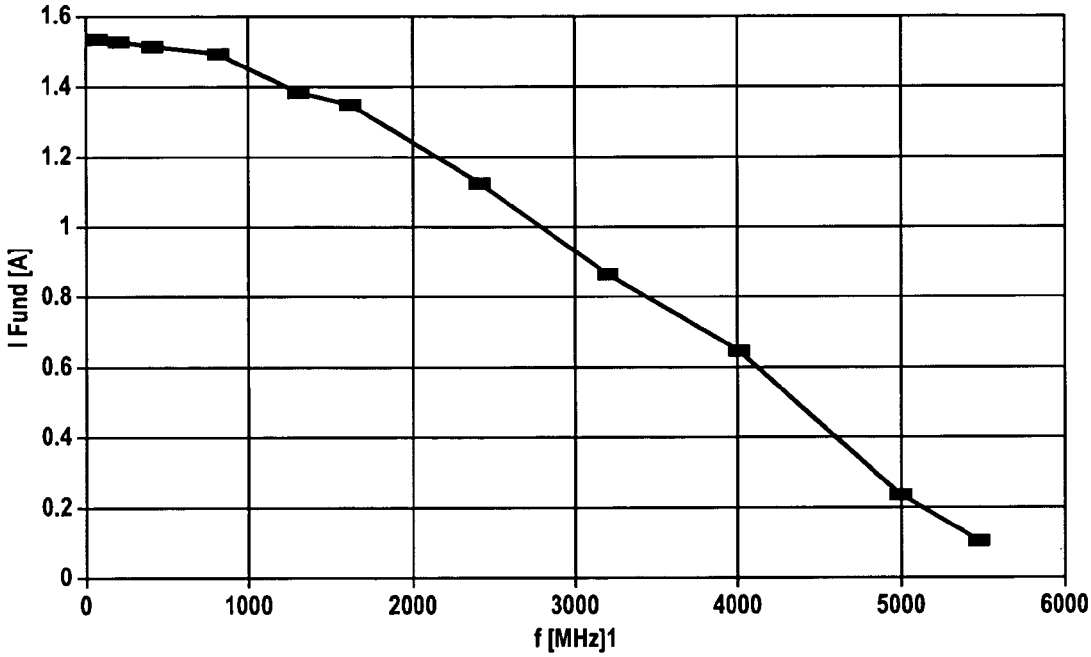
FIG. 3 is a graph of simulated fundamental frequency current of an existing IOT gun versus frequency at 22 kV beam voltage and 47.4 Volts peak RF grid voltage operating in Class B.
Figure 4A:
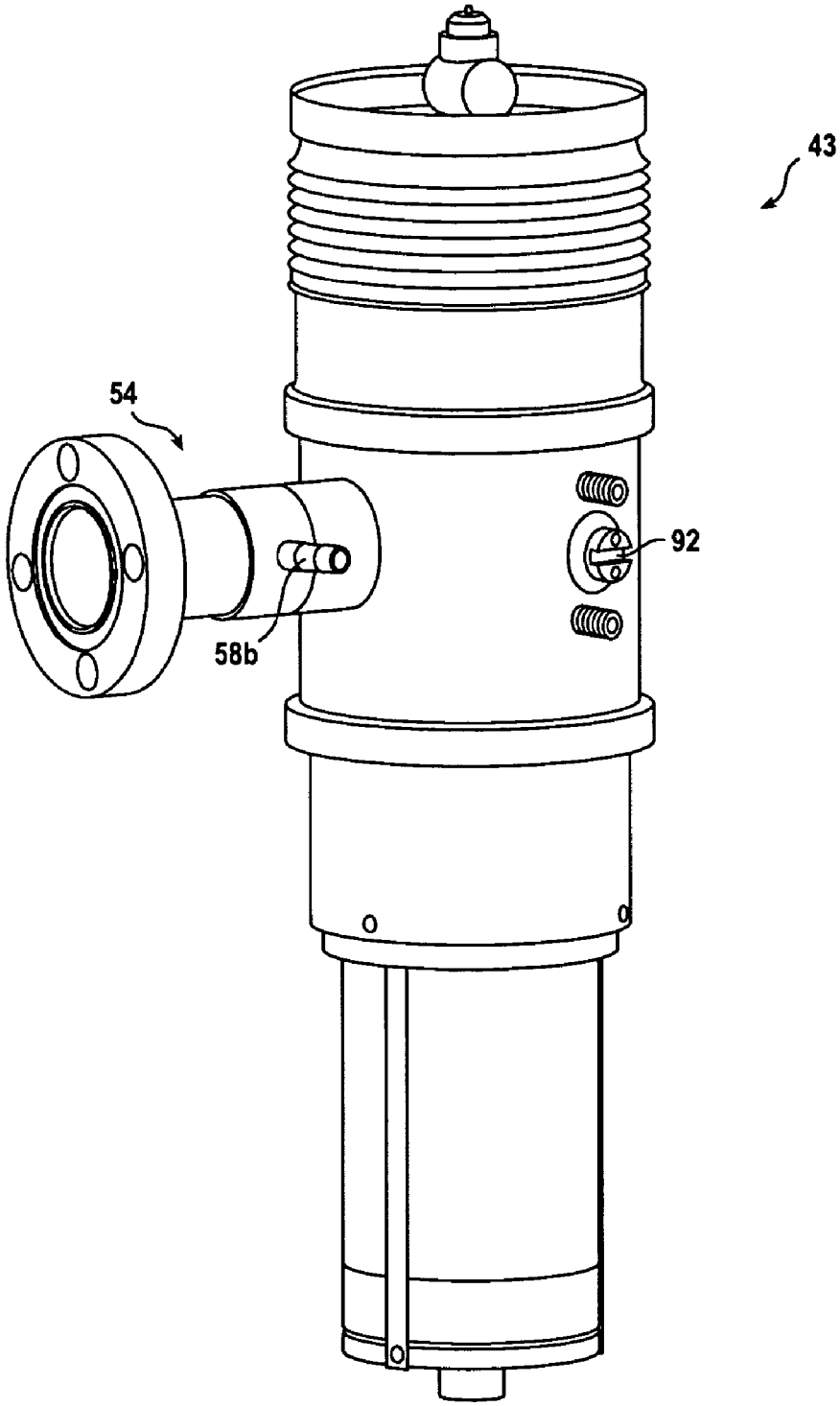
FIGS. 4A and 4B are diagrams offset with respect to each other by about 90 degrees showing the external configuration of an L-Band IOT in accordance with an embodiment of the present invention.
Figure 4B:
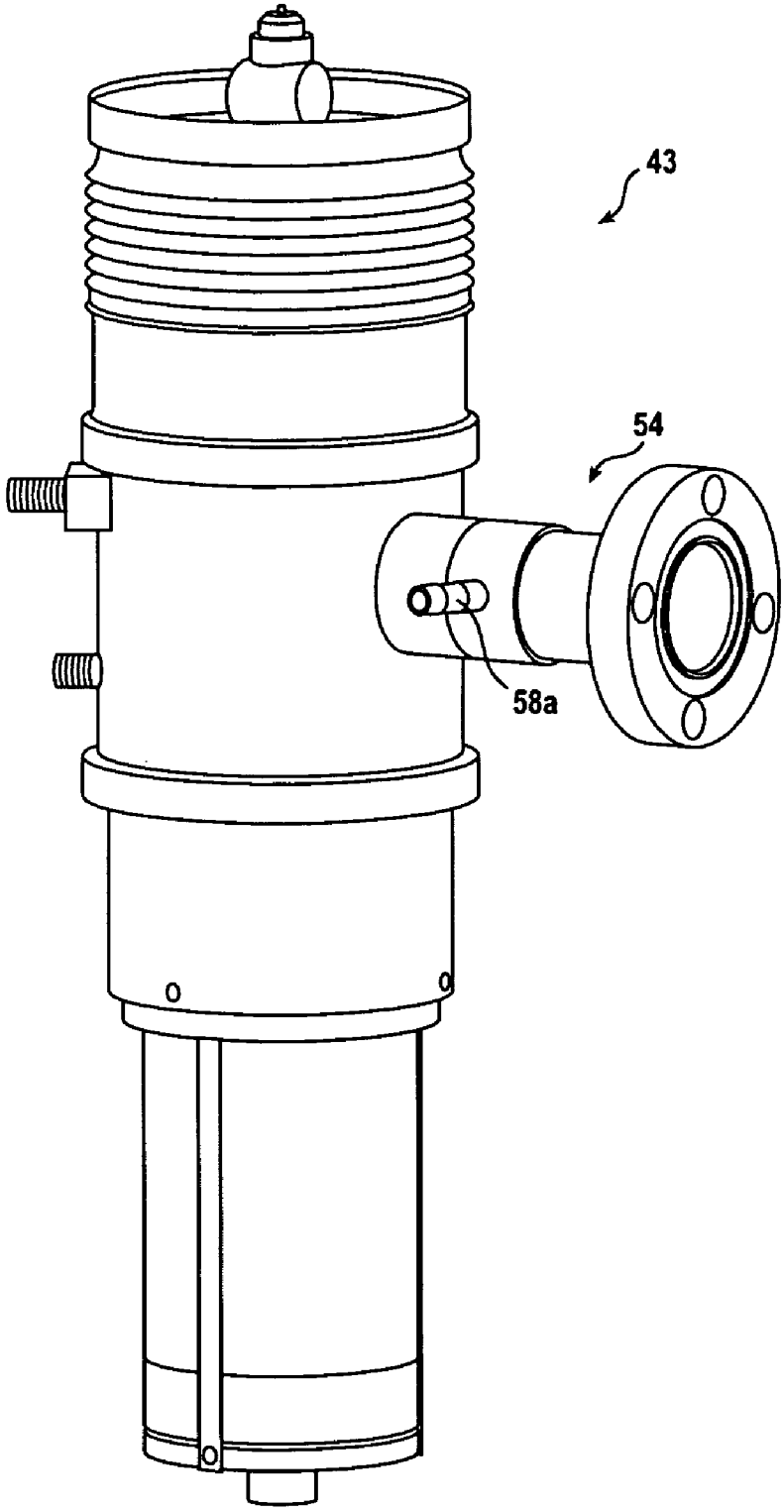
Figure 5:
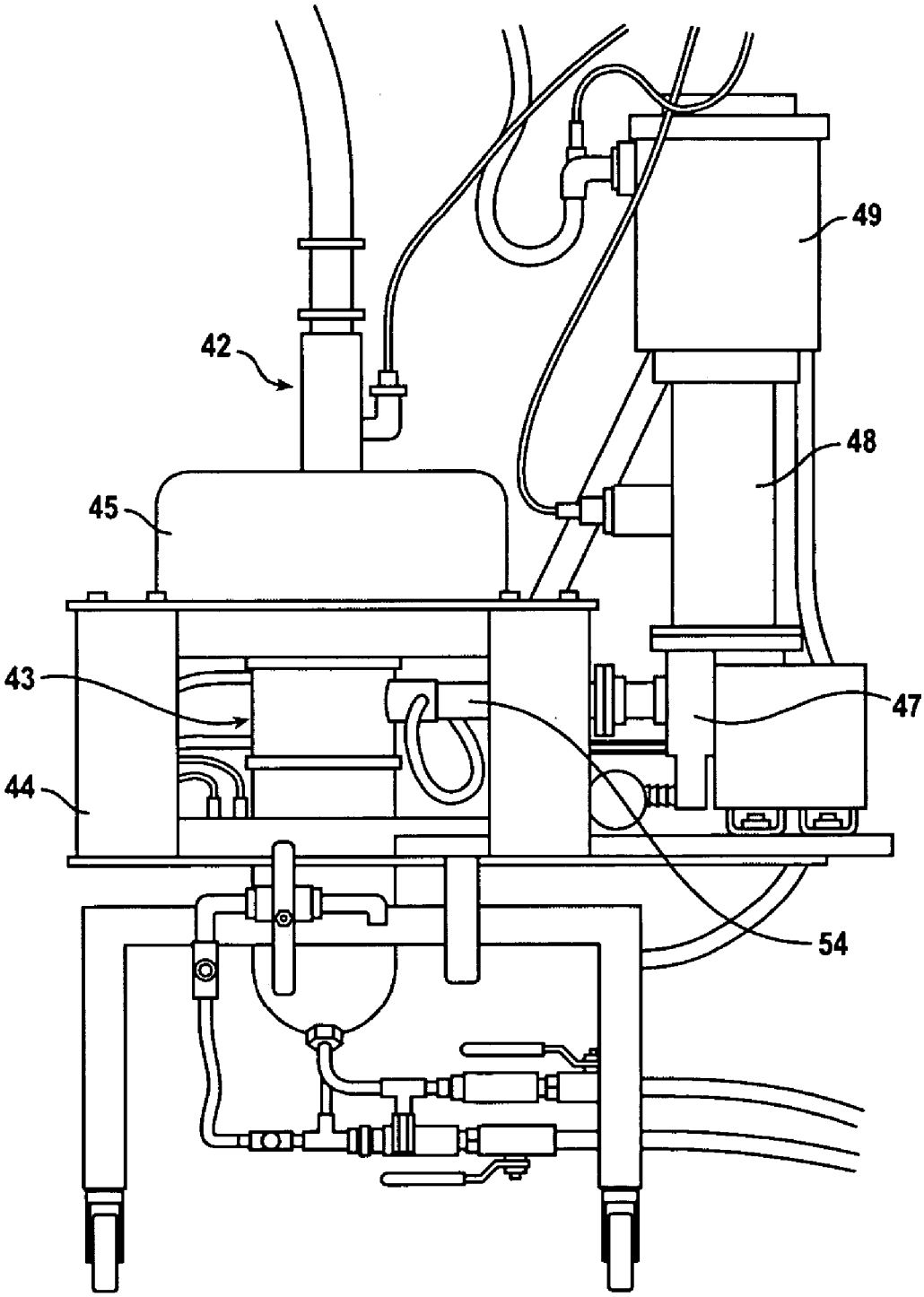
FIG. 5 is a diagram showing an L-Band IOT in accordance with an embodiment of the present invention as it was configured for operation.
Figure 6:
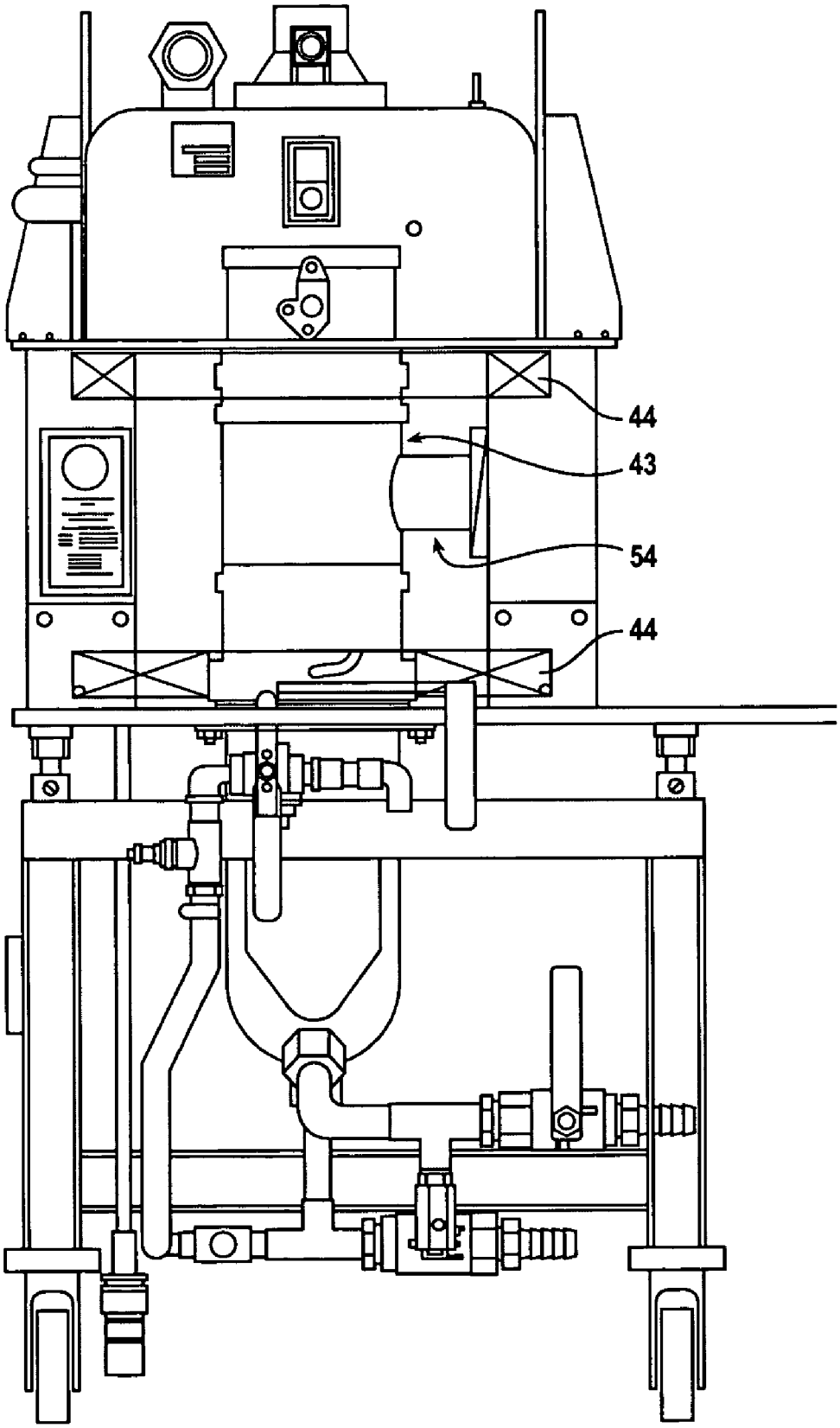
FIG. 6 is a front elevational diagram of an L-Band IOT in accordance with an embodiment of the present invention as it would be configured as a product.

FIGS. 4A and 4B are diagrams offset with respect to each other by about 90 degrees showing the external configuration of the L-Band IOT 43. FIG. 5 is a diagram showing the L-Band IOT 43 as it is configured for operation. FIG. 6 is a front elevational diagram of the L-Band IOT as it would be configured as a product. In FIG. 5 the IOT is shown mounted within its magnetic focusing circuit 44. The box 45 on top contains the conventional high-voltage connections (cathode, heater, grid bias, ion getter pump) and the input circuitry. The magnetic circuit is supported by a cart shown in detail in FIG. 6 which also contains the cooling water connections. The output coupling 54 leads to a coaxwaveguide transition 47 on top of which a directional coupler 48 and a water-cooled load 49 are visible (FIG. 5).

Figure 7:
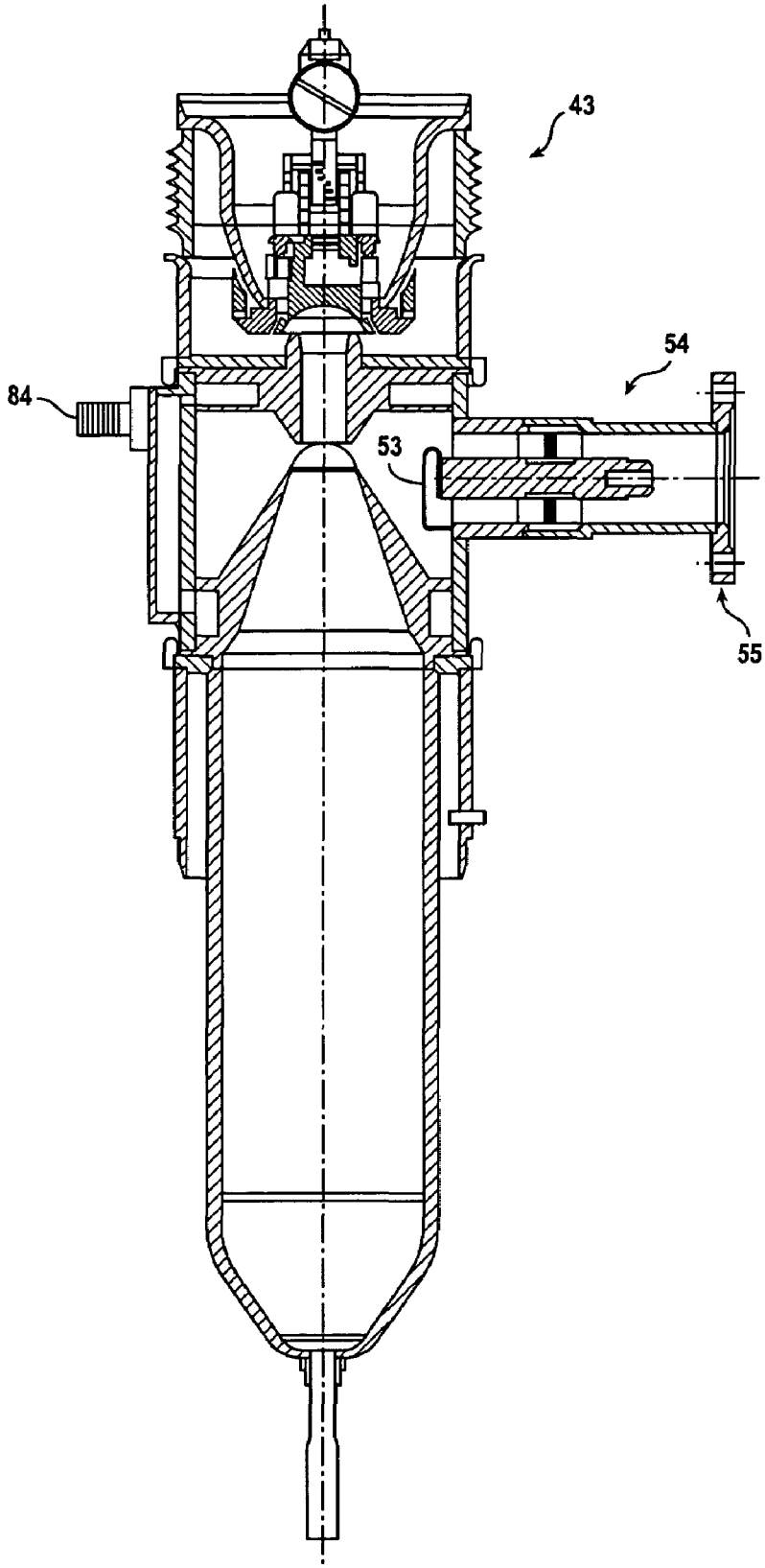
FIG. 7 is a cross-sectional view of an L-Band IOT in accordance with an embodiment of the present invention.
Figure 9:
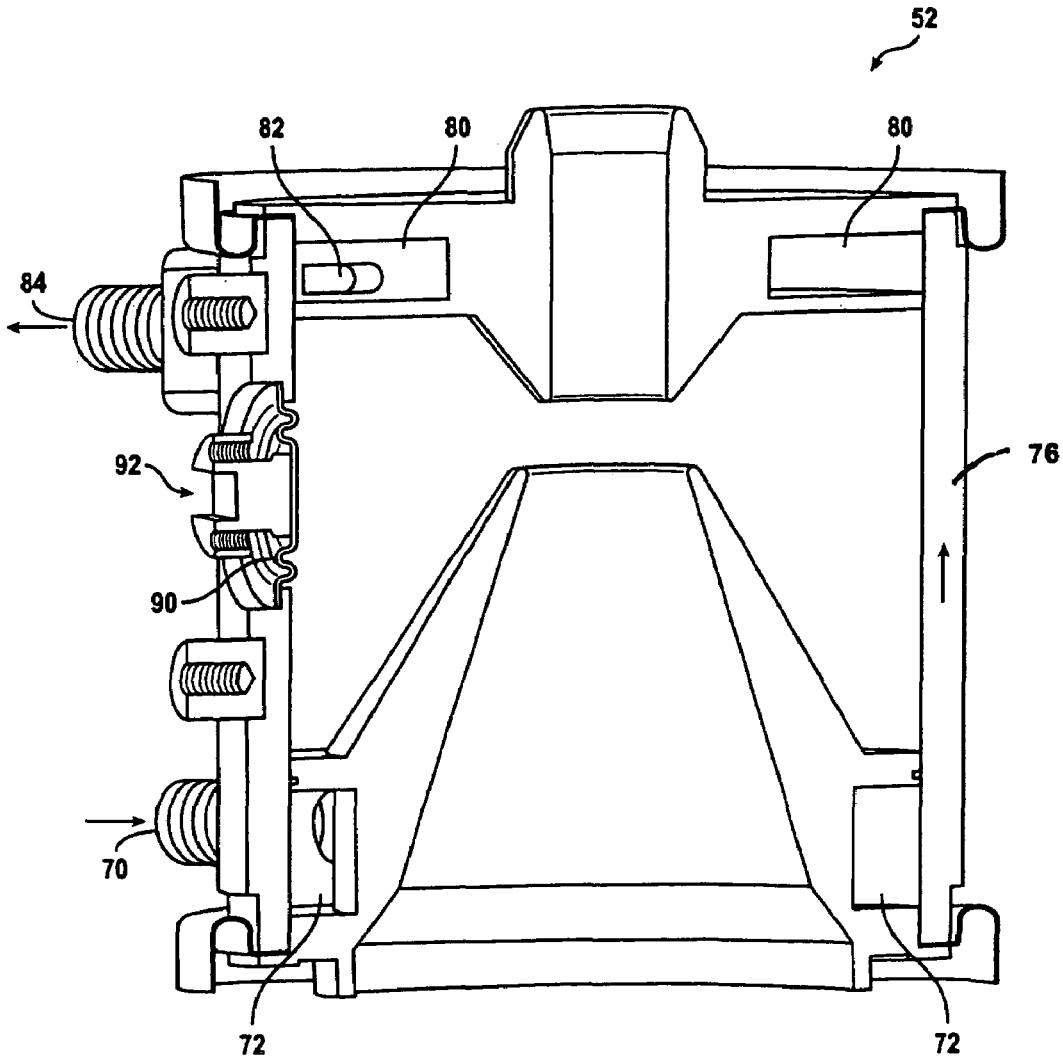
FIG. 9 is a cutaway diagram of an output cavity of an L-Band IOT in accordance with an embodiment of the present invention.
Figure 10:
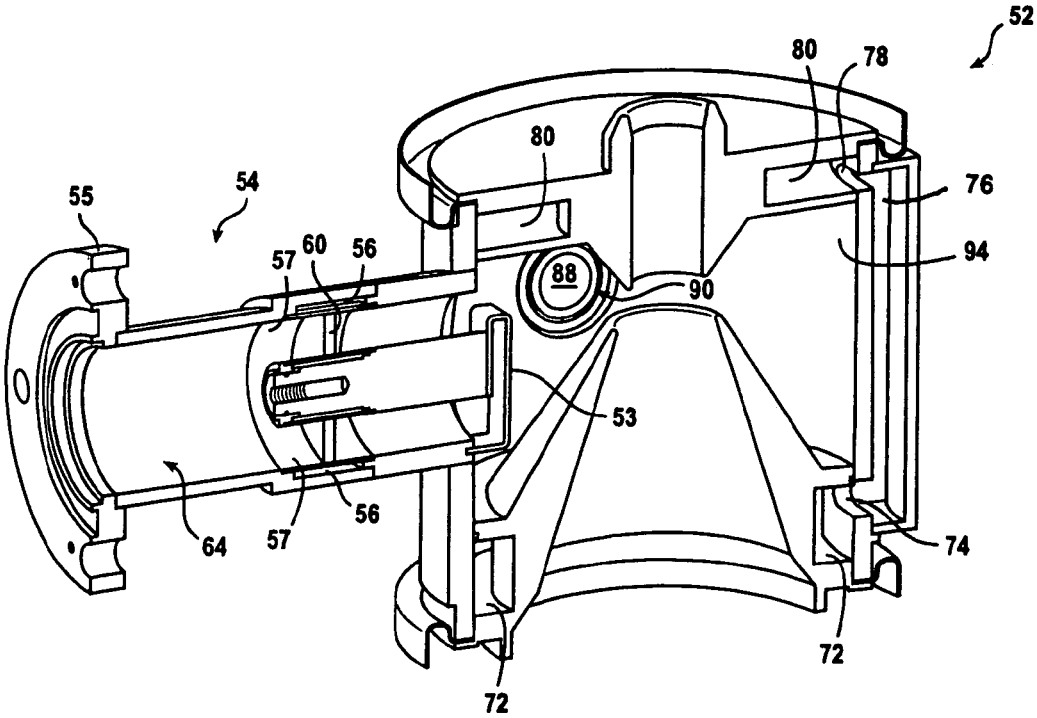
FIG. 10 is a cutaway diagram of an output cavity of an L-Band IOT in accordance with an embodiment of the present invention. The views of FIGS. 9 and 10 are offset with respect to each other by about 90 degrees.
Figure 11:
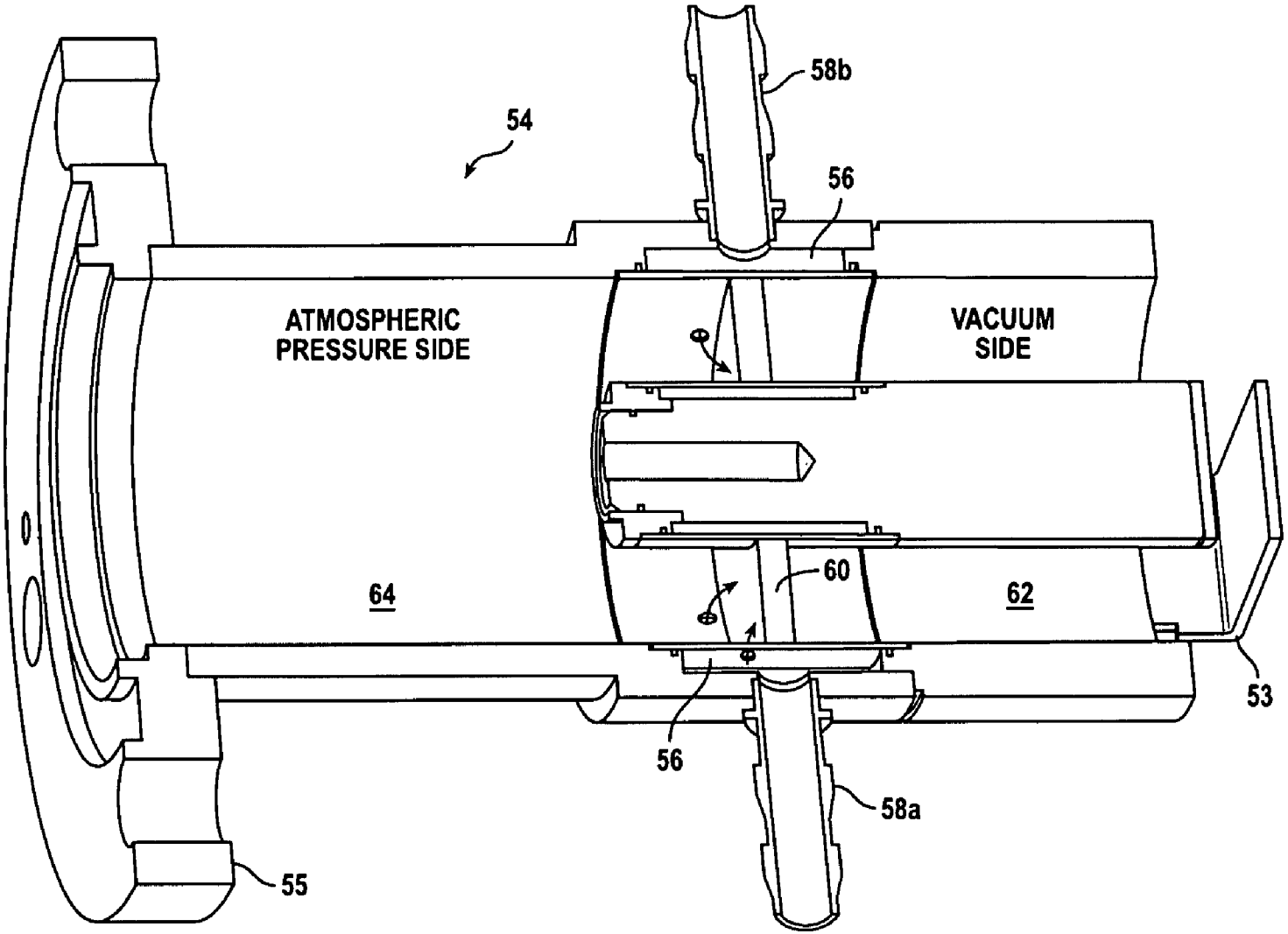
FIG. 11 is a cutaway diagram of an output coupling of an L-Band IOT in accordance with an embodiment of the present invention.

FIG. 7 is a cross-sectional view of the IOT 43. FIG. 8 is a cross-sectional view of integral output cavity 52 of IOT 43. FIGS. 9 and 10 are cutaway diagrams of output cavity 52 of IOT 43. The views of FIGS. 9 and 10 are offset with respect to each other by about 90 degrees. FIG. 11 is a cutaway diagram of output coupling 54. Coupling loop 53 couples RF energy from within output cavity 52 to output coupling 54.

Turning now to FIGS. 4A, 4B, 5, 6, 7, 8, 9, 10 and 11, the IOT 43 includes an output coupling 54 disposed at 90 degrees to a longitudinal axis of IOT 43. Output coupling 54 provides an interface to a 1⅝-inch diameter circular waveguide at flange 55. Output coupling 54 includes a manifold 56 fed with cooling air by a pair of input nipples 58*a*, 58*b*. The manifold is formed about alumina output window 60. The vacuum side 62 of output coupling 54 is held at vacuum. Alumina output window 60 separates the vacuum side 62 from the atmospheric pressure side 64 of output coupling 54. Manifold 56 has a number of apertures 57 passing from manifold 56 into the atmospheric pressure side 64 of output coupling 54 in a region immediately adjacent to output window 60. These apertures are provided to blow cooling air over output window 60 which air is, in turn, exhausted down the output coupling module and circular waveguide attached thereto (not shown). By providing this output window cooling mechanism, the thermal gradient across the ceramic window is minimized, thus reducing thermal stress that may cause window failure over time.

Operating the IOT 43 at L-Band frequencies results in a relatively large amount of waste heat being deposited in the structure of the output cavity 52. Absent an efficient mechanism for removing this waste heat, the waste heat would result in distortion of the structure of the output cavity 52 and consequent undesired distortions in the output signal. For example, any shift in the size or shape of the output cavity 52 would likely change the resonant frequency of the structure and thus its impedance at a given operating frequency. To reduce or eliminate these distortions, a cooling system is provided for the output cavity 52. A liquid coolant such as pressurized deionized water (or another suitable liquid coolant such as a cooling oil, air, polyethylene glycol, polyethylene glycol mixed with water, mixtures of deionized water and other materials or other well-known non-corrosive coolants) is provided to the cooling system through input port 70. From port 70 the liquid coolant passes into lower chamber 72 where it circulates about the lower chamber (which may be formed in a circular or other convenient shape) to remove heat from the structure, then passes through port 74 into vertical channel 76 (there is preferably a single vertical channel) and up through vertical channel 76, through port 78 and into upper chamber 80 (which may be formed in a circular or other convenient shape) where it circulates to remove heat from the structure, through port 82 and out water exhaust port 84. The structure of the output cavity 52 may be constructed, for example, of oxygen-free high-conductivity copper to provide good thermal conductivity and low corrosion so that the waste heat is efficiently removed by the output cavity cooling system.

The output cavity 52 can be tuned slightly in frequency. In order to accomplish this, a diaphragm 88 is mounted on a flexible flange 90 (FIGS. 9 and 10). The flange 90 makes a vacuum seal with the body 94 of the output cavity. A mechanical device 92 such as a bolt moving in threads or any other convenient mechanism for urging the flange 88 into the cavity 52 is used to push the flange 88 into cavity 52. Flexible flange 90 acts as a biasing element to push diaphragm 88 back from cavity 52. Adjustment of the position of diaphragm 88 slightly adjusts the resonant frequency of cavity 52 and provides a frequency adjustment for the IOT. Other biasing mechanisms, such as an exterior mounted spring coupled to the diaphragm could also be used as will now be apparent to those of ordinary skill in the art.

As with all linear beam types, the L-Band IOT design can be fabricated with a multi-stage depressed collector (MSDC), fed with a plurality of power supplies if desired.

The integral output cavity 52 used in the present invention includes its resonant structure as a part of the vacuum envelope, whereas the more common method for IOTs is to use an external tuning box to adjust the resonant frequency. This approach yields a tube of a relatively fixed frequency, but manufacturing variations may result in the tube having a resonant frequency that is slightly different than that desired. Accordingly, the diaphragm and flange tuning system described in detail above is used herein to adjust the volume of the integral output cavity 52 for the purpose of fine-tuning the resonant frequency of the IOT.

Table 2 lists typical test results for output power levels in the 20–30 kW range.

TABLE 2

Typical Prototype Test Results

| Beam Voltage | Beam Current | Output Power | Gain | Efficiency |
|---|---|---|---|---|
| 30 kV | 1.23 A | 20.1 kW | 21.1 dB | 54.4% |
| 34 kV | 1.58 A | 29.5 kW | 22.5 dB | 59.0% |

It is believed that these tests mark the first time that an IOT had been operated at a frequency beyond the UHF band (i.e., above 1000 MHz).

While embodiments and applications of this invention have been shown and described, it will now be apparent to those skilled in the art having the benefit of this disclosure that many more modifications than mentioned above are possible without departing from the inventive concepts disclosed herein. Therefore, the appended claims are intended to encompass within their scope all such modifications as are within the true spirit and scope of this invention.

What is claimed is:

1. An inductive output tube (IOT) adapted to amplify an input RF signal into an output RF signal, the input RF signal and the output RF signal having the same predetermined frequency range above 1000 MHz, the IOT comprising:

a cathode adapted to emit a linear electron beam;

a grid comprised of non-electron emissive material adapted to density modulate the beam, when the input RE signal is applied between the cathode and the grid;

an anode adapted to form an electric field in combination with the cathode for accelerating the beam;

a collector adapted to collect the spent beam; an output cavity resonant to a frequency of the input RF signal, the output cavity positioned between the anode and the collector; and a coupler adapted to couple the output RF signal from the output cavity to a load, the coupler including an output window separating a vacuum portion of the IOT from an atmospheric pressure portion of the IOT, the output window surrounded by a cooling air manifold, the manifold including an air input port and a plurality of apertures permitting cooling air to move from the input air port, through the manifold and into the atmospheric pressure portion of the IOT.

2. The IOT of claim 1, wherein the atmospheric pressure portion of the IOT comprises a section of circular waveguide.

3. The IOT of claim 2, wherein the output window comprises alumina.

4. The IOT of claim 3, wherein the output cavity further comprises:

a liquid coolant input port;

a lower coolant channel coupled to receive liquid coolant from the liquid coolant input port;

at least one vertical coolant channel coupled to receive liquid coolant from the lower coolant channel;

an upper coolant channel coupled to receive liquid coolant from the at least one vertical coolant channel; and a liquid coolant exhaust port coupled to receive liquid coolant from the upper coolant channel.

5. The IOT of claim 4, wherein there is only a single vertical coolant channel coupling the lower coolant channel and the upper coolant channel.

6. The IOT of claim 4, wherein the upper coolant channel and the lower coolant channel are circular in shape.

7. The IOT of claim 4, wherein the collector is a single stage collector.

8. The IOT of claim 4, wherein the collector is a multi-stage depressed collector.

9. The IOT of claim 4, wherein the output cavity further comprises a vacuum tight diaphragm which can be moved into and out of the output cavity by manipulating a tuning control accessible on the exterior of the IOT.

10. The IOT of claim 9, wherein the tuning control comprises a threaded screw.

11. The IOT of claim 9, wherein the movement of the diaphragm changes a frequency at which the output cavity is resonant.

12. An inductive output tube (IOT) adapted to amplify an input RF signal into an output RF signal, the input RF signal and the output RF signal having the same predetermined frequency range above 1000 MHz, the IOT comprising;

a cathode adapted to emit a linear electron beam;

a grid comprised of non-electron emissive material adapted to density modulate the beam, when the input RF signal is applied between the cathode and the grid;

an anode adapted to form an electric field in combination with the cathode for accelerating the beam;

a collector adapted to collect the spent beam;

an output cavity resonant to a frequency of the input RF signal, the output cavity positioned between the anode and the collector; and a coupler adapted to couple the output RE signal from the output cavity to a load wherein the output cavity further comprises:

a liquid coolant input port;

a lower coolant channel coupled to receive liquid coolant from the liquid coolant input port;

at least one vertical coolant channel coupled to receive liquid coolant from the lower coolant channel;

an upper coolant channel coupled to receive liquid coolant from the at least one vertical coolant channel; and a liquid coolant exhaust port coupled to receive liquid coolant from the upper coolant channel.

13. The IOT of claim 12, wherein there is only a single vertical coolant channel coupling the lower coolant channel and the upper coolant channel.

14. The IOT of claim 12, wherein the upper coolant channel and the lower coolant channel are circular in shape.

15. An inductive output tube (IOT) for amplifying an input RF signal into an output RF signal, the input RF signal and the output RF signal having the same predetermined frequency range above 1000 MHz, the IOT comprising:

a cathode adapted to emit a linear electron beam;

a grid comprised of non-electron emissive material adapted to density modulate the beam, the grid being positioned from the cathode no farther than a distance in which electrons emitted from the cathode can travel in a quarter cycle of the input RE signal, wherein the input RE signal is arranged to be applied between the cathode and the grid;

an anode adapted to form an electric field in combination with the cathode for accelerating the beam;

a collector adapted to collect the spent beam;

an output cavity resonant to a frequency of the input RF signal, the output cavity positioned between the anode and the collector;

a coupler adapted to couple the output RF signal from the output cavity into a load, the coupler having an output window separating a vacuum portion of the IOT from an atmospheric pressure portion of the IOT, the output window surrounded by a cooling air manifold, the manifold including an air input port and a plurality of apertures permitting cooling air to move from the port, through the manifold and into the atmospheric pressure portion of the IOT.

16. The IOT of claim 15, wherein the atmospheric pressure portion of the IOT comprises a section of circular waveguide.

17. The IOT of claim 15, wherein the output window comprises alumina.

18. The IOT of claim 15, wherein the output cavity comprises:

a liquid coolant input port;

a lower coolant channel coupled to receive liquid coolant from the liquid coolant input port;

a vertical coolant channel coupled to receive liquid coolant from the lower coolant channel;

an upper coolant channel coupled to receive liquid coolant from the vertical coolant channel; and a liquid coolant exhaust port coupled to receive liquid coolant from the upper coolant channel.

19. The IOT of claim 18, wherein the upper coolant channel and the lower coolant channel are substantially circular in shape.

20. The IOT of claim 18, wherein said collector is a single stage collector.

21. The IOT of claim 18, wherein said collector is a multi-stage depressed collector.

22. The IOT of claim 18, wherein the output cavity further comprises a vacuum tight diaphragm which can be moved into and out of the output cavity by manipulating a tuning control accessible on the exterior of the IOT.

23. The IOT of claim 22, wherein the tuning control comprises a threaded screw.

24. The IOT of claim 22, wherein the movement of the diaphragm changes a frequency at which the output cavity is resonant.

25. The IOT of claim 15, wherein the output cavity further comprises a vacuum tight diaphragm which can be moved into and out of the output cavity by manipulating a tuning control accessible on the exterior of the IOT.

26. The IOT of claim 25, wherein the tuning control comprises a threaded screw.

27. The IOT of claim 25, wherein the movement of the diaphragm changes a frequency at which the output cavity is resonant.

28. An inductive output tube (IOT) adapted to amplify an input RF signal into an output RF signal, the input RF signal and the output RF signal having the same predetermined frequency range above 1000 MHz, the IOT comprising:

a cathode adapted to emit a linear electron beam;

a grid comprised of non-electron emissive material, the grid adapted to density modulate the beam, the grid positioned from the cathode no farther than a distance in which electrons emitted from the cathode can travel in a quarter cycle of the input RF signal, wherein the grid and the cathode are adapted to receive the input RF signal;

an anode adapted to form an electric field in combination with the cathode for accelerating the beam;

a collector adapted to collect the beam;

an output cavity resonant to a frequency of the input RF signal, the output cavity positioned between the grid and the collector and including:

a liquid coolant input port;

a lower circular coolant channel coupled to receive liquid coolant from the liquid coolant input port;

a vertical coolant channel coupled to receive liquid coolant from the lower circular coolant channel;

an upper circular coolant channel coupled to receive liquid coolant from the vertical coolant channel; and a liquid coolant exhaust port coupled to receive liquid coolant from the upper circular coolant channel; and a coupler adapted to couple the output RF signal from the output cavity to a load.

29. The IOT of claim 28, wherein the collector is a single stage collector.

30. The IOT of claim 28, wherein the collector is a multi-stage depressed collector.

31. The IOT of claim 28, wherein the output cavity further comprises a vacuum tight diaphragm which can be moved into and out of the output cavity by manipulating a tuning control accessible on the exterior of the JOT.

32. The IOT of claim 31, wherein the tuning control comprises a threaded screw.

33. The IOT of claim 31, wherein the movement of the diaphragm changes a frequency at which the output cavity is resonant.

34. An inductive output tube (IOT) adapted to amplify an input RF signal into an output RF signal, the input RF signal and the output RF signal having the same predetermined frequency range above 1000 MHz, the IOT comprising:

a cathode adapted to emit a linear electron beam;

a grid comprised of non-electron emissive material, the grid adapted to density modulate the beam, the grid positioned from the cathode no farther than a distance in which electrons emitted from the cathode can travel in a quarter cycle of the input RF signal, wherein the IOT is adapted to have the input RF signal applied between the cathode and the grid;

an anode adapted to form an electric field in combination with the cathode for accelerating the beam;

a collector adapted to collect the spent beam;

an output cavity resonant to a frequency of the input RF signal, the output cavity positioned between the grid and the collector, the output cavity including a vacuum tight diaphragm which can be moved into and out of the output cavity by manipulating a tuning control accessible on the exterior of the IOT;

a coupler adapted to couple the output RF signal from the output cavity to a load; and an output window separating a vacuum portion of the IOT from an atmospheric pressure portion of the IOT and a through which cooling air is introduced at the atmospheric pressure side of the output window for cooling the output window.

35. The IOT of claim 34, wherein the collector is a single stage collector.

36. The IOT of claim 34, wherein the collector is a multi-stage depressed collector.

37. The IOT of claim 34, wherein the output window is surrounded by a cooling air manifold, the manifold including an air input port and a plurality of apertures permitting cooling air to move from the port, through the manifold and into the atmospheric pressure portion of the IOT.

38. The IOT of claim 37, wherein the output cavity further comprises a vacuum tight diaphragm which can be moved into and out of the output cavity by manipulating a tuning control accessible on the exterior of the IOT.

39. The IOT of claim 38, wherein the tuning control comprises a threaded screw.

40. The IOT of claim 38, wherein the movement of the diaphragm changes a frequency at which the output cavity is resonant.

41. The IOT of claim 34, wherein the output cavity comprises:

a liquid coolant input port;

a lower coolant channel coupled to receive liquid coolant from the liquid coolant input port;

a vertical coolant channel coupled to receive liquid coolant from the lower coolant channel;

an upper coolant channel coupled to receive liquid coolant from the vertical coolant channel; and a liquid coolant exhaust port coupled to receive liquid coolant from the upper coolant channel.

42. The IOT of claim 41, wherein the output cavity further comprises a vacuum tight diaphragm which can be moved into and out of the output cavity by manipulating a tuning control accessible on the exterior of the IOT.

43. The IOT of claim 42, wherein the tuning control comprises a threaded screw.

44. The IOT of claim 42, wherein the movement of the diaphragm changes a frequency at which the output cavity is resonant.

45. The IOT of claim 34, wherein the tuning control comprises a threaded screw.

46. The IOT of claim 34, wherein the movement of the diaphragm changes a frequency at which the output cavity is resonant.

47. An inductive output tube (IOT) adapted to amplify an input RF signal into an output RF signal, the input RF signal and the output RF signal having the same predetermined frequency range above 1000 MHz, the IOT comprising:

a cathode adapted to emit a linear electron beam;

a grid comprised of non-electron emissive material adapted to density modulate the beam, when the input RF signal is applied between the cathode and the grid;

an anode adapted to form an electric field in combination with the cathode for accelerating the beam;

a collector adapted to collect the spent beam;

an output cavity resonant to a frequency of the input RF signal, the output cavity positioned between the anode and the collector; and a coupler adapted to couple the output RE signal from the output cavity to a load wherein the output cavity further comprises an airtight flexible diaphragm which can be moved into and out of the output cavity by manipulating a tuning control accessible on the exterior of the IOT.

48. The IOT of claim 47, wherein the tuning control comprises a threaded screw.

49. The IOT of claim 47, wherein the movement of the diaphragm changes a frequency at which the output cavity is resonant.

50. An inductive output tube (IOT) adapted to amplify an input RF signal into an output RF signal, the input RF signal and the output RF signal having the same predetermined frequency range above 1000 MHz, the IOT comprising:

means for emitting a linear electron beam;

means for density modulating the beam;

means for accelerating the beam;

means for collecting the spent beam; and means for coupling the output RF signal to a load, said means for coupling including means for separating a vacuum portion from an atmospheric pressure portion, and means for cooling said means for separating.

* * * * *

UNITED STATES PATENT AND TRADEMARK OFFICE

CERTIFICATE OF CORRECTION

PATENT NO. : 7,145,297 B2
APPLICATION NO. : 10/982192
DATED : December 5, 2006
INVENTOR(S) : Heinz P. Bohlen et al.

It is certified that error appears in the above-identified patent and that said Letters Patent is hereby corrected as shown below:

TITLE PAGE, ITEM (75) Inventors: replace “Tomoe” with --Tornoe--.

In column 7, line 5, before “circular” insert --a--.

Signed and Sealed this

Sixth Day of November, 2007

JON W. DUDAS
*Director of the United States Patent and Trademark Office*